United States Patent [19]

De La Harpe

[11] Patent Number: 4,630,999

[45] Date of Patent: Dec. 23, 1986

[54] AXIAL FAN

[75] Inventor: Jean H. De La Harpe, Transvaal, South Africa

[73] Assignee: James Howden & Company Limited, Glasgow, Scotland

[21] Appl. No.: 659,639

[22] Filed: Oct. 11, 1984

[30] Foreign Application Priority Data

Oct. 14, 1983 [EP] European Pat. Off. ..... 83306249.0

[51] Int. Cl.[4] ..... F04D 29/36

[52] U.S. Cl. ..... 416/167; 416/147; 416/205

[58] Field of Search ..... 416/205, 147, 245 B, 416/157 R, 157 C, 168 R

[56] References Cited

U.S. PATENT DOCUMENTS

| | | | |
|---|---|---|---|
| 1,927,592 | 9/1933 | Lambert | 416/147 |
| 2,080,540 | 5/1937 | Isaac | 416/205 X |
| 2,685,933 | 8/1954 | Terzi | 416/131 X |
| 2,844,303 | 7/1958 | Kristiansen | 416/167 X |

FOREIGN PATENT DOCUMENTS

| | | | |
|---|---|---|---|
| 495335 | 8/1953 | Canada | 416/164 |
| 779013 | 3/1935 | France | 416/168 |
| 1008184 | 5/1952 | France | 416/205 |
| 1059705 | 3/1954 | France | 416/164 |
| 23709 | 2/1977 | Japan | 416/205 |
| 637238 | 5/1950 | United Kingdom | 416/168 R |

*Primary Examiner*—Everette A. Powell, Jr.
*Attorney, Agent, or Firm*—Barnes & Thornburg

[57] ABSTRACT

An axial flow fan with adjustable blades 18 has a spindle 16 for each blade mounted in a hub rim 12. Each spindle has associated therewith a replaceable cartridge 58 having a thrust bearing 70 therein and spaced radial bearings 64, 70. In order to service the bearing, the cartridge can simply be disconnected, e.g. by unscrewing from the rim having removed the blade 18.

8 Claims, 3 Drawing Figures

AXIAL FAN

The present invention relates to axial flow fans. Such fans when produced on a large scale, for example to feed combustion air to a boiler of a power station, or used in a mine ventilating system, usually comprise a hub, a plurality of bearings mounted on said hub, in circumferentially spaced relationship, a blade spindle being mounted in each bearing and extending radially outwardly from the hub. Each of these spindles is arranged to be pivotal about its own axis in the associated bearing, and a fan blade is carried by each spindle for pivotal movement therewith. An operating mechanism is provided for causing the pivotal movement thereof, to give adjustment of the blade angle to suit the particular instantaneous requirements of demand imposed upon the fan. For example, if the fan is used for feeding combustion air to a boiler in a power station, there is very often a significant fluctation in the air demand of the boiler for various reasons including the demand on the generator, and the wetness and/or calorific value of the fuel. For this reason the operating mechanism is constantly operating to adjust the blade angle to suit the particular instantaneous requirement. The number of movements of the blade can amount to 5000 or more in a day, the fan running 24 hours a day.

It has been found that a significant amount of wear can take place in the bearings and when this wear does take place the disassembly of the fan to replace a particular bearing is an extremely laborious, time-consuming and expensive operation.

It is now proposed, according to the present invention, for each spindle to have associated therewith a replaceable cartridge having a casing surrounding said spindle and releasably engageable on the hub of the fan, a thrust bearing and spaced radial bearings being mounted within said casing to take up axial and radial loads between the spindle and the casing.

By providing a replaceable cartridge, all that one needs to do is to remove the particular blade from its spindle, and then dismount the cartridge casing. This can be fixed to the hub, for example, by means of a screwthread, a bayonet fitting or the like, although a screwthread is preferred. Such an operation involves minimum disassembly of the fan and the operation can be carried out significantly more quickly and more cheaply than has hitherto been possible.

In a preferred construction the thrust bearing is a tapered roller, self-aligning bearing and this thus can provide one of the spaced radial bearings.

The cartridge may include an inner sleeve mounted to support the thrust bearing, from its radially inner side with respect to the axis of the fan. A thrust bearing retaining nut may be threadedly engaged with the casing to urge the thrust bearing radially inwardly against the inner sleeve advantageously giving an axial preload by means of a spring means interposed between the thrust bearing and the inner sleeve.

Because of the very substantial radial forces on any lubricant within the thrust bearing, a grease retaining cap is preferably urged by the nut against the radially outer (with respect to the fan axis) face of the thrust bearing and serves to retain the grease or other lubricant within the thrust bearing.

The inner sleeve is advantageously engaged directly on its associated spindle and a bearing bush is disposed between the inner sleeve and the casing to provide one of the radial bearings.

While it is contemplated that the thrust bearing can be located towards the radially inner end of the spindle, it is preferably mounted so that it is located adjacent the radially outer end of the associated spindle. It has been found that when thus positioned the dismounting of the cartridge is considerably facilitated.

In order that the invention may more readily be understood, the following description is given, merely by way of example, reference being made to the accompanying drawings, in which.

Figure 1:
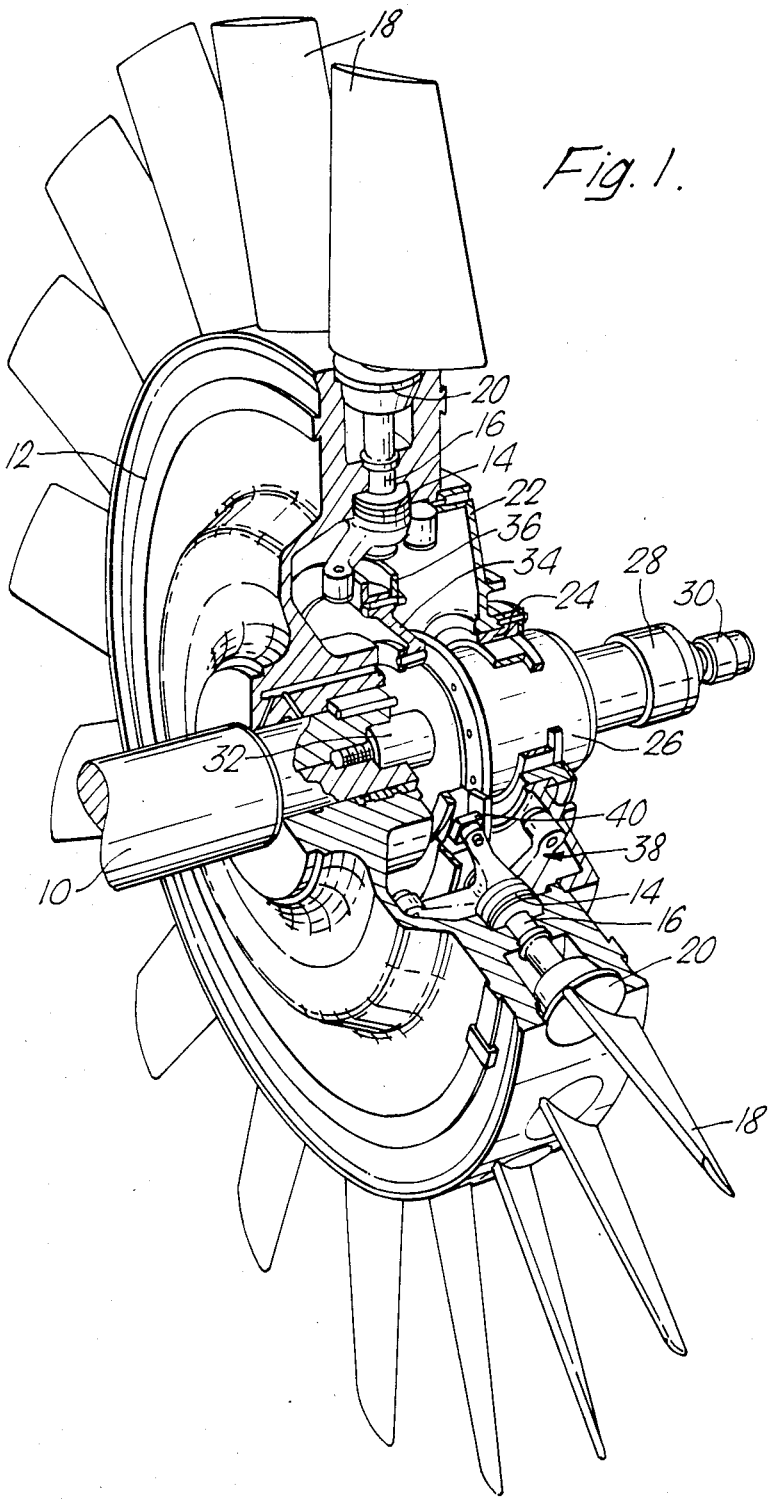
FIG. 1 is a schematic perspective view, with parts broken away, to illustrate the interior, of one embodiment of known fan rotating assembly.

Referring now to FIG. 1 of the drawings, the conventional fan illustrated therein includes an impeller shaft 10 carrying an impeller hub 12 in which are mounted a plurality of circumferentially spaced thrust bearings 14. Mounted for limited rotation within each thrust bearing is a blade spindle 16 on the radially outer end of each of which is mounted a blade 18 having a connector 20 screwed onto the end of the spindle 16.

A hub cover 22 has mounted therewithin an actuator support bearing 24 within which is mounted an hydraulic actuator 26 the axial movement of which is controlled by a spool valve 28 mounted on a rotating union 30. An actuator piston retaining rod 32 is shown within a regulating disc 34 which is provided with an external channel 36.

Each spindle 16 has, at its radially inner end a regulating and balance lever assembly 38, one of the arms 39 of which is provided with a thrust block 40 engaged in the channel 36. The signal from the spool valve causes the actuator to cause axial movement of the regulating disc 34 and its associated channel 36 which causes axial movement, with respect to the shaft of the fan, of the thrust block 40 which in turn causes pivoting of each blade spindle 16 and its associated blade 18 about the axis of that spindle, thereby to adjust the angle of each blade. It will be appreciated that all the blades are adjusted in the same way simultaneously.

The assembly so far described is very satisfactory in normal operation but the main problem which arises is wear of the bearing 14. In order to replace such a bearing, the whole fan has to be disassembled and this is a very expensive and time-consuming operation.

Figure 2:
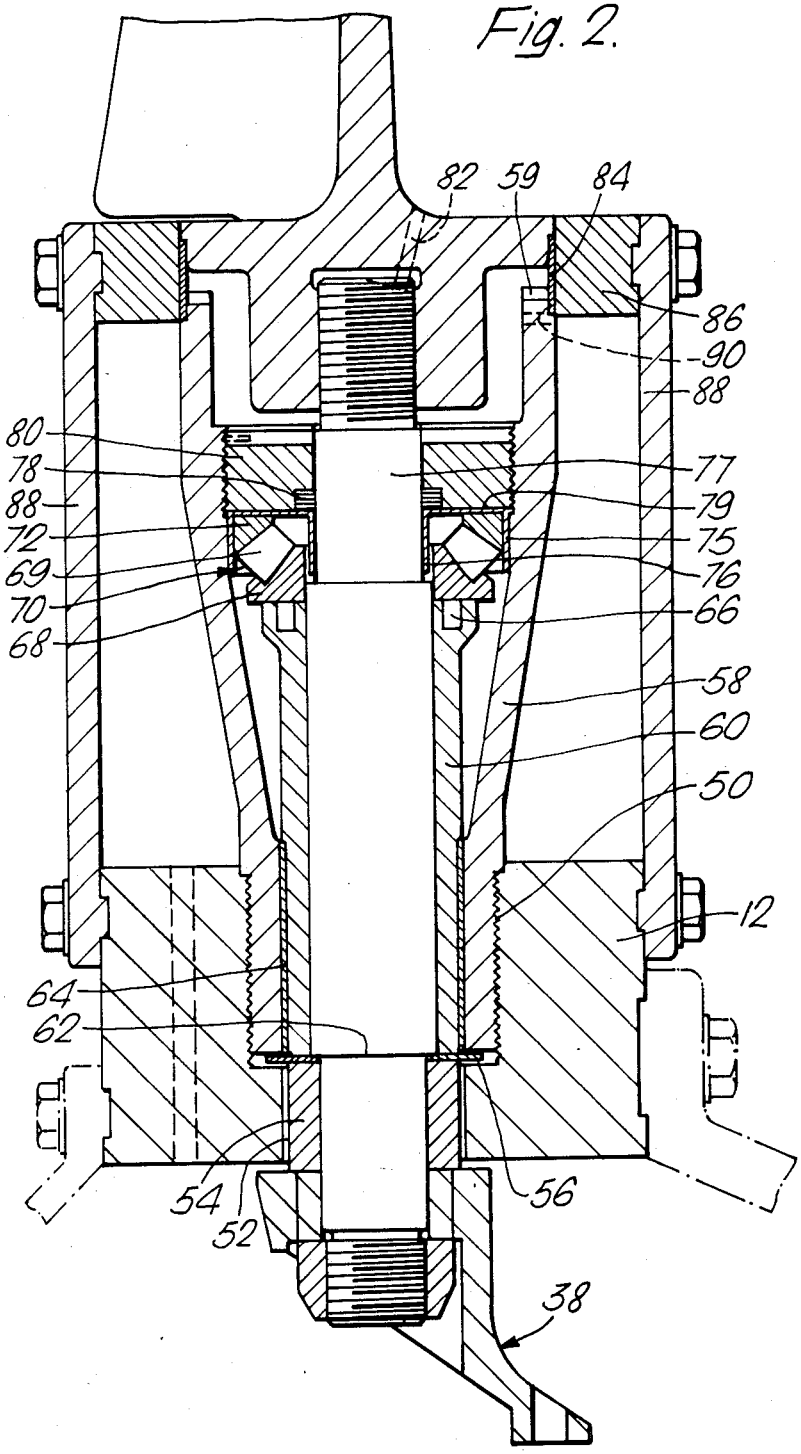
FIG. 2 is a cross-section through one embodiment of cartridge suitable for modifying the structure illustrated in FIG. 1.

The arrangement according to the invention illustrated in FIG. 2 overcomes this disadvantage. The inner hub rim 12 is provided with a plurality of circumferentially spaced threaded bores 50 at the location of each blade spindle 16. A reduced diameter portion 52 of the bore 50 accommodates a spindle sleeve 54 which abuts the upper surface of the associated balance lever assembly 38 and has thereabove a spindle retaining washer 56.

Threaded into the bore 50 is a cartridge casing 58 provided at its upper end with a spanner engageable diametral recess 59 to enable the cartridge casing 58 to be screwed into the threaded bore 50. A bearing support sleeve 60 is mounted on the shaft 16, as a sliding or pushfit, and the lower end of the sleeve 60 rests on the retaining washer 56. It will be noted that this retaining washer is located at the position of a shoulder 62 of the spindle. Positioned between the inner support sleeve 60 and the casing 58 is a sintered metal impregnated bearing bush 64 which serves as a rotary bearing for the support sleeve 60 and thus for the shaft 16.

At its upper end the bearing support sleeve 60 is widened and accommodates preloading springs 66 which bear against the lower race 68 of a thrust bearing which is in the form of a tapered roller, self-aligning bearing 70 having the lower race 68, rollers 69 and an upper race 72.

A grease retaining cap 74 is mounted with a peripheral flange 75 extending as a force fit between the outer surface of the bearing 70 and the inner surface of the casing 58. A similar inner flange 76 is engaged against the stepped down portion 77 of the spindle 16. A seal 78 is mounted axially above the grease retaining cap and a bearing retaining nut 80 is threaded into the interior of the casing and forces the grease retaining cap 74 against the thrust bearing 70 and forces the thrust bearing 70 against the inner bearing support sleeve 60.

A blade locking screw 82 is passed through the connector 20 and engages against the threaded end of the shaft 16 to retain the blade in place on the shaft. A dust seal 84 is provided around the upper end of the cartridge and connector 20 and is engaged within an outer hub rim 86. A hub cover plate 88 may be provided on each side of the cartridges. A cartridge locking screw 90 threaded through the cartridge engages with the outer hub rim 86 to prevent the cartridge itself from unscrewing.

In order to dismount the bearing, the locking screw 82 is released and the blade 18 and its connector are unscrewed from the end of the shaft 16. The bearing retaining nut 80 can then be removed whereafter the whole cartridge 58 can be unscrewed taking with it the thrust bearing 70 and the bearing support sleeve 60 as well as the bush 64. If necessary the shaft 16 can subsequently be removed although this is usually not necessary. The various components, including the bush 64 and the thrust bearing can readily be replaced and the assembly carried out in the reverse order.

Figure 3:
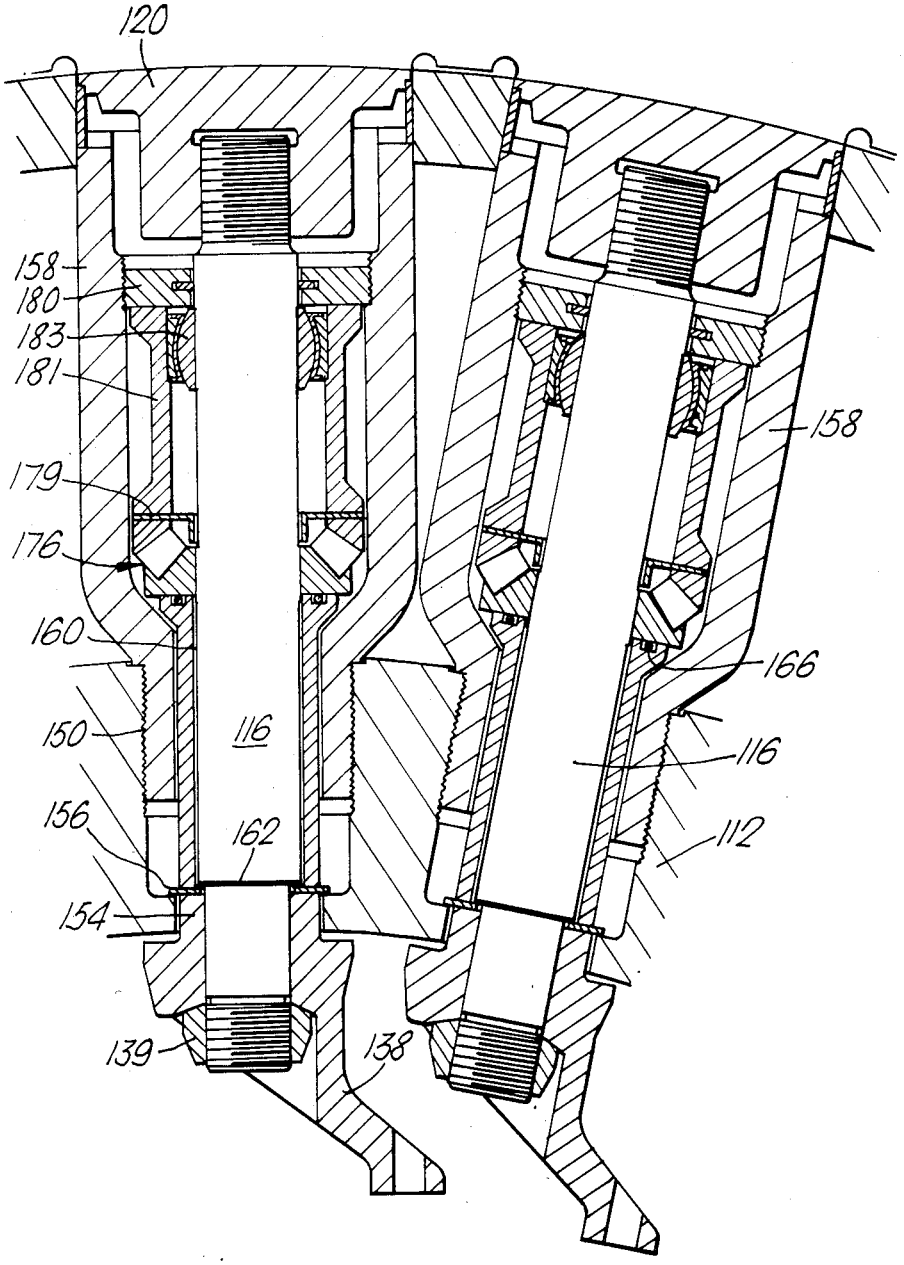
FIG. 3 is a cross-section through two adjacent cartridges of an alternative construction of fan according to the present invention.

FIG. 3 illustrates another structure according to the invention which is generally similar and like parts have been indicated by like reference numerals with the addition of 100. Thus, each shaft 116 is surrounded by a cartridge casing 158 which is threaded into a bore 150 in an inner hub rim 112. Again, each shaft is surrounded by an inner bearing support sleeve 160 which bears against a spindle retaining washer 156 which is engaged against a shoulder 162 of the shaft. In this construction the spindle sleeve 154 is formed integrally with the balance lever assembly 138 which is held onto the spindle by a spindle nut 139. Again the thrust bearing 170 is mounted on top of the bearing support sleeve 160 and is provided with a grease retaining cap 174. However, in this construction instead of the bearing retaining nut 180 being mounted directly on top of the grease retaining cap 174, there is interposed a further support tube 181 having a spherical bearing 183 mounted on the shaft 116 and located radially outwardly, with respect to the axis of rotation of the fan, of the thrust bearing 170. This forms the radial bearing which is mounted outwardly of the thrust bearing in this embodiment whereas in the embodiment of FIG. 2 it is mounted radially inwardly thereof. In fact it has been found that the construction of FIG. 2 is rather easier to dismantle and remount than that of FIG. 3.

I claim:

1. An axial flow fan comprising a hub, a plurality of bearings mounted on said hub in circumferentially spaced relationship, a blade spindle mounted on each bearing and extending radially relative to said hub, and each blade spindle being pivotable about its own axis in the associated bearing, a fan blade removably carried by each spindle for pivotal movement therewith, an operating mechanism for causing the pivotal movement thereof to give adjustment to the blade angle and, associated with each spindle, a replaceable cartridge, each replaceable cartridge comprising a tubular casing coaxially surrounding its associated spindle, a threaded inner end portion of said tubular casing removably threaded into the hub of the fan, a thrust bearing and at least one radial bearing axially spaced from said thrust bearing mounted wholly within each said tubular casing to take up axial and radial loads, respectively, between said spindle and casing, said thrust bearing and at least one radial bearing being mounted wholly within said casing, effective to be removable from the hub and shaft as the tubular casing is removed from the hub as a unit leaving the spindle mounted on the hub.

2. A fan as claimed in claim 1, wherein said thrust bearing is a tapered roller, self-aligning bearing, also providing one of said axially spaced radial bearings.

3. A fan as claimed in claim 1 wherein each cartridge comprises an inner sleeve, mounted to support said thrust bearing from its radially inner side with respect to the axis of the fan.

4. A fan as claimed in claim 3, and further comprising a thrust bearing retaining nut threadably engageable with said casing, effective to urge said thrust bearing radially inwardly against said inner sleeve.

5. A fan as claimed in claim 4, and further comprising a grease retaining cap mounted so as to be urged by said nut against the radially outer face of said thrust bearing.

6. A fan as claimed in claim 3, and further comprising spring means interposed between the thrust bearing and said inner sleeve, whereby said thrust bearing is axially preloaded.

7. A fan as claimed in claim 3 wherein each said inner sleeve is engaged directly on its associated spindle and further comprising a bearing bush disposed between said inner sleeve and said casing to provide one of said radial bearings.

8. A fan as claimed in claim 1, wherein each thrust bearing is located adjacent the radially outer end of its associated spindle.

* * * * *